US012490791B2

(12) United States Patent
Mulcahy

(10) Patent No.: US 12,490,791 B2
(45) Date of Patent: Dec. 9, 2025

(54) WEARABLE APPAREL WITH POCKETS

(71) Applicant: Steven Mulcahy, San Diego, CA (US)

(72) Inventor: Steven Mulcahy, San Diego, CA (US)

( * ) Notice: Subject to any disclaimer, the term of this patent is extended or adjusted under 35 U.S.C. 154(b) by 129 days.

(21) Appl. No.: 18/190,866

(22) Filed: Mar. 27, 2023

(65) Prior Publication Data

US 2024/0172823 A1 May 30, 2024

Related U.S. Application Data

(60) Provisional application No. 63/324,130, filed on Mar. 27, 2022.

(51) Int. Cl.

| | |
|---|---|
| ***A41D 27/20*** | (2006.01) |
| ***A41D 23/00*** | (2006.01) |
| ***A41D 27/08*** | (2006.01) |
| ***A41D 27/22*** | (2006.01) |

(52) U.S. Cl.

CPC ..... *A41D 27/201* (2013.01); *A41D 23/00* (2013.01); *A41D 27/08* (2013.01); *A41D 27/22* (2013.01); *A41D 2300/322* (2013.01)

(58) Field of Classification Search

CPC ..... A41D 27/201; A41D 23/00; A41D 27/08; A41D 27/22; A41D 2300/322

See application file for complete search history.

(56) References Cited

U.S. PATENT DOCUMENTS 306,248 A * 10/1884 Harris ..... A41D 27/22 2/271
766,963 A * 8/1904 Murray ..... A41D 23/00 2/206
932,357 A * 8/1909 Trestman ..... A41D 27/22 2/271
1,002,623 A * 9/1911 Alder ..... A41D 23/00 2/90
1,022,504 A * 4/1912 Raughtigan ..... A41D 27/22 2/271
1,113,640 A * 10/1914 Jenoi ..... A41D 27/22 2/271
1,399,523 A * 12/1921 Sable ..... A41D 23/00 2/203
2,247,272 A * 6/1941 Becher ..... A41D 23/00 D2/601
2,464,113 A * 3/1949 Bernstein ..... G09F 3/14 40/672
2,479,731 A * 8/1949 Dibrell ..... A41D 23/00 428/4
2,510,720 A * 6/1950 Siegel ..... A41D 23/00 2/65
2,530,453 A * 11/1950 Eagle ..... A44C 15/004 D2/857
2,620,478 A * 12/1952 Milly ..... A41D 23/00 D2/605

(Continued)

*Primary Examiner* — Khaled Annis
(74) *Attorney, Agent, or Firm* — Eastman IP

(57) ABSTRACT

A wearable apparel that has pockets usable as a storage compartment for multitudes of items. The wearable apparel with pockets can be tied around different areas of the body as well as on animals. There is a thin and flexible metal strip in the middle section of the wearable apparel with pockets that the user can conform into different shapes to achieve a better fit. The user can zip the pocket compartments shut to secure any items located inside the pockets.

19 Claims, 3 Drawing Sheets

(56) References Cited

U.S. PATENT DOCUMENTS 2,870,448 A * 1/1959 Rosenthal ..... A41D 23/00 2/92
3,088,119 A * 5/1963 Grant ..... A41D 23/00 2/130
3,280,488 A * 10/1966 Rubin ..... G09F 3/00 2/249
3,286,276 A * 11/1966 Calisch ..... A41D 23/00 2/207
4,462,117 A * 7/1984 Brunelle ..... A41D 23/00 2/202
4,532,410 A * 7/1985 Wehmeyer ..... H05B 3/342 219/549
4,654,897 A * 4/1987 Rosaen ..... A41D 23/00 2/207
4,718,123 A * 1/1988 Petropoulos ..... A41D 23/00 2/91
5,007,115 A * 4/1991 Denbow ..... A41D 23/00 2/202
5,621,919 A * 4/1997 Graham ..... A41D 23/00 132/274
5,802,613 A * 9/1998 Marshall ..... A41D 23/00 2/144
6,226,799 B1 * 5/2001 Lane ..... A41D 23/00 2/207
8,505,117 B2 * 8/2013 Park ..... A41D 23/00 2/202
10,499,697 B1 * 12/2019 Posta ..... A41D 27/201
11,026,457 B1 * 6/2021 Mayer ..... A41D 27/201
11,607,030 B1 * 3/2023 Bell ..... A45F 5/02
11,963,562 B1 * 4/2024 Grieco ..... A41D 3/005
2002/0108164 A1 * 8/2002 Dixon ..... A42B 1/041 2/207
2004/0026919 A1 * 2/2004 Bleckmann ..... B65H 45/28 283/81
2004/0210984 A1 * 10/2004 Cohen ..... A41D 23/00 2/171
2005/0039242 A1 * 2/2005 Edmondson ..... A42B 1/004 2/207
2005/0229291 A1 * 10/2005 Gendall ..... A41D 23/00 2/206
2006/0010569 A1 * 1/2006 Tawfik ..... A41D 23/00 2/207
2006/0064795 A1 * 3/2006 Houghton ..... A41D 23/00 2/88
2006/0137072 A1 * 6/2006 Visco ..... A41D 23/00 2/127
2007/0055207 A1 * 3/2007 Dureus ..... A41D 15/00 2/207
2010/0071109 A1 * 3/2010 Gibson ..... A41D 27/08 2/244
2010/0107301 A1 * 5/2010 Gallo ..... A41D 23/00 2/207
2010/0319105 A1 * 12/2010 Fairbanks ..... A41D 13/11 2/209.13
2011/0056001 A1 * 3/2011 Missett ..... A41D 27/201 2/244
2011/0061151 A1 * 3/2011 Chang ..... A41D 13/11 2/9
2011/0191940 A1 * 8/2011 Johnson ..... A41D 23/00 2/207
2011/0197339 A1 * 8/2011 Warren ..... A41D 13/1161 2/173
2011/0197340 A1 * 8/2011 Kummerfeldt .... A41D 13/1107 2/207
2012/0066812 A1 * 3/2012 Alzate ..... A41D 27/20 2/202
2012/0144557 A1 * 6/2012 Walker ..... A41D 23/00 2/207
2012/0204323 A1 * 8/2012 Park ..... A41D 23/00 2/202
2013/0227761 A1 * 9/2013 Hoskins ..... A41D 15/005 2/207
2013/0276212 A1 * 10/2013 Lee-Holowka ..... A45F 5/02 2/271
2014/0101822 A1 * 4/2014 Womack ..... A41D 23/00 2/206
2014/0130227 A1 * 5/2014 Stark ..... A41D 17/00 2/59
2014/0259334 A1 * 9/2014 Mitchell ..... A41D 23/00 2/461
2015/0007377 A1 * 1/2015 Pavalon ..... A41D 23/00 2/69
2015/0052661 A1 * 2/2015 Poznick ..... A41D 23/00 2/202
2016/0213959 A1 * 7/2016 Barklow ..... A41D 13/1107
2016/0249696 A1 * 9/2016 Wallen ..... A41D 23/00 2/91
2017/0181488 A1 * 6/2017 Perello ..... A41D 19/01
2017/0208881 A1 * 7/2017 Leathers ..... A41D 23/00
2018/0092417 A1 * 4/2018 Klar ..... A41D 23/00
2018/0235297 A1 * 8/2018 Buczkowski ..... A41D 27/20
2018/0352879 A1 * 12/2018 Goulina ..... A41D 11/00
2020/0085126 A1 * 3/2020 Barnes ..... A41D 27/08
2021/0145094 A1 * 5/2021 Diemer ..... A41D 23/00
2021/0401082 A1 * 12/2021 Roffe ..... A41D 23/00
2022/0015491 A1 * 1/2022 Stevens ..... A42B 3/28
2022/0061404 A1 * 3/2022 Horwatt ..... A62B 23/025
2022/0071318 A1 * 3/2022 Lee ..... A62B 23/025
2023/0051552 A1 * 2/2023 Chartrand ..... A41D 13/0512
2023/0123875 A1 * 4/2023 Mastel ..... A41D 27/20 2/91
2023/0147043 A1 * 5/2023 Baglin ..... A41D 13/1107 128/863
2024/0172823 A1 * 5/2024 Mulcahy ..... A41D 23/00

* cited by examiner

WEARABLE APPAREL WITH POCKETS

RELATED APPLICATION

This application claims priority to United States Provisional Patent Application Ser. No. 63/324,130 for "Wearable Apparel with Pockets," filed Mar. 27, 2022, and currently, the entirety of which is incorporated herein by reference.

FIELD OF THE INVENTION

The present invention pertains generally to apparel. More particularly, an elongated piece of apparel with a thin and flexible metal strip in a middle section and pockets at each end for use in wearing for fashion, protection, or for storing items is disclosed. The present invention is particularly, but not exclusively, useful as a scarf with storage capability.

BACKGROUND OF THE INVENTION

Fashion is an ever-changing industry that has followed many different trends and ideas throughout history. Many influencers and designers try their best to promote their wearable apparel to mass users. These promotions target user's fashion preferences that may differ based on parameters including, but not limited to, location or functionality requirements.

In general, the target for these different wearable apparels is people. Thus, these wearable apparels should appeal to the user's fashion choice and functionality needs. One of many ways wearable apparel must be fashionable and functional is during a gathering of large crowds such as concerts, conventions, or rallies. Not only do people want to show off their fashion, but they want to ensure their items are safe from theft that may occur at these gatherings. These thefts will likely occur if one places items in an always open pocket located on major apparel items such as shirts, jackets, pants, skirts, or shorts.

Many users also wear apparel for protective purposes. For instance, wearing a piece of apparel over the nose may block airborne particles such as dust, bacteria, or viruses from entering the body.

Although there are usually designs, patterns, and colors that suit the user's fashion preferences, existing wearable apparel lacks important features of functionality and protection from extrinsic factors.

In light of the above, it would be beneficial to provide a wearable garment that is both functional and stylish.

SUMMARY OF THE INVENTION

Disclosed is a wearable apparel with pockets designed for users to safely store items, be protected, and dress in any configuration the user desires. The wearable apparel with pockets has a long fabric length, and variable width, which allows the user to tie the invention in different places. In a preferred embodiment, it also includes a thin and flexible metal strip and pocket compartments with zippers.

A preferred embodiment of the wearable apparel with pockets is made up of two long substantially rectangular fabric pieces stitched together along the periphery and with threading running along the top, both ends, and bottom outside borders of the rectangle. The term "substantially rectangular" is used herein to indicate that the apparel, and the two principal fabric pieces, have a general rectangular shape, but that in some embodiments the shape deviates slightly from a perfect rectangle: For example, in one embodiment there is a mild tapering at the top portion, so that the apparel is taller in the middle portion than at the ends. The length of the fabric allows the user to wear the invention in multiple configurations in different places such as on the face or waist. The stitching creates an open space between the two long rectangular fabric pieces.

A thin, flexible, and deformable metal strip is between the two rectangular fabric pieces and is attached to the two rectangular fabric pieces from the inside. As to the invention's rectangular shape, the metal strip is in the middle and runs across horizontally lengthwise near the top border. The user may bend the metal strip, so the fabric adapts with the metal strip, into whatever configuration is required for a better, tighter fit, such as over the nose-bridge for the wearer to use the garment as a mask.

The pockets with zippers are located on the top border of the invention where the thread stitching is visible. One pocket in this preferred configuration is between the one side border and the metal strip. The second pocket lies between the metal strip and the other side border. These pockets allow the user to store items and close the openings of the pockets with the zippers to secure the items inside.

BRIEF DESCRIPTION OF THE DRAWINGS

The novel features of this invention, as well as the invention itself, both as to its structure and its operation, will be best understood from the accompanying drawings, taken along with the accompanying description, in which similar reference characters refer to similar parts, and in which.

DETAILED DESCRIPTION

Figure 1:
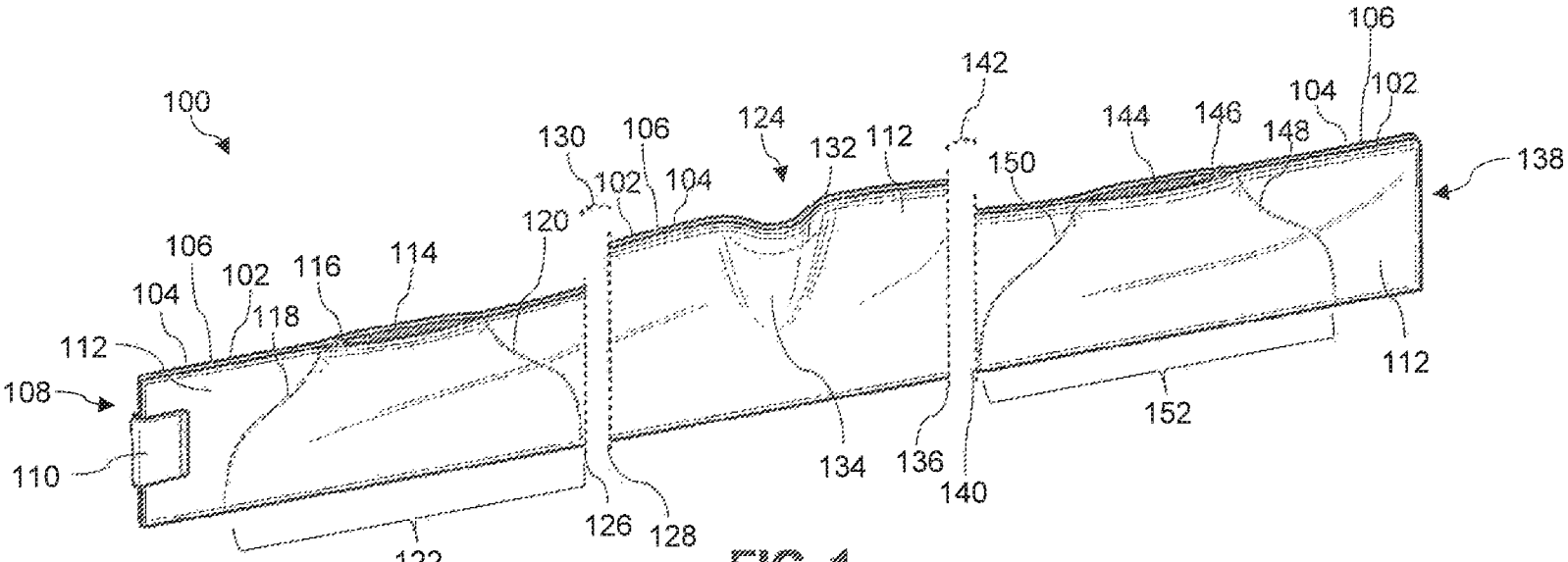
FIG. 1 is a top front perspective view of a preferred embodiment of the wearable apparel with pockets showing the fabric layers and two pockets in an open configuration.

Referring initially to FIG. 1, a top front perspective view of the preferred embodiment of the wearable apparel with pockets 100 is shown. The wearable apparel with pockets 100 has a front substantially rectangular fabric piece 102 connected to the back substantially rectangular fabric piece 104 by stitched threading 106. In some embodiments, these two fabric pieces have the same design, the same color, or both; in other embodiments, design, color, or both differ between the fabric pieces. The stitched threading 106 runs along the outside borders of the front rectangular fabric piece 102 and back rectangular fabric piece 104. Because of the stitched threading 106, there is an open space between the front rectangular fabric piece 102 and back rectangular fabric piece 104.

In a preferred embodiment, the first section 108 of the wearable apparel with pockets 100 contains a tag 110 that is stitched to the front face 112 of the front rectangular fabric piece 102. The tag 110 also wraps around the front face 112 ends up at the back rectangular fabric piece 104. The tag 110 contains, but is not limited to, customizable messages about brand names, personal names, or advertisement. There is the first pocket compartment 114 located on the top side border of the wearable apparel with pockets 100. The first zipper 116 positioned over the first pocket threaded stitching 118—the first pocket threaded stitching 118 located on the front face 112—shows the first pocket compartment 114 is in an open configuration. To place the pocket in a closed configuration, the first zipper 116 slides over the first pocket compartment 114 and ends over the second pocket threaded stitching 120—second pocket threaded stitching 120 located on the front face 112. The front rectangular fabric piece 102 and back rectangular fabric piece 104, as stitched together along the perimeter and stitching 118 and 120, and with zipper 116 providing an opening, define the first pocket compartment 114 for storing the user's items. The space of this compartment 114 spans the first length 122 between the first pocket threaded stitching 118 to the second pocket threaded stitching 120.

In a preferred embodiment, the first section 108 of the wearable apparel with pockets 100 has the narrowest width at the tag 110 end. The first section 108 gradually becomes wider as it transitions to the middle section 124 of the wearable apparel with pockets 100 which is shown by the first width dotted lines 126. The first section's 108 maximal width, and the first section's 108 transition point to the middle section 124, are shown by the second width dotted line 128. The continuance of the first section 108 to the middle section 124 is shown by the first arch dotted lines 130.

In a preferred embodiment, the middle section 124 of the wearable apparel with pockets 100 has the largest width of the invention. The middle section also shows the same front rectangular fabric piece 102 connected to the back rectangular fabric piece 104 by stitched threading 106 continued from the left end 108. In a preferred embodiment, a thin and flexible metal strip 132 is in the open space, and near the top border, between the connected front rectangular fabric piece 102 and back rectangular fabric piece 104. The thin and flexible metal strip 132 is attached to the front rectangular fabric piece 102 and back rectangular fabric piece 104 from the inside open space. In a preferred embodiment, the thin and flexible metal strip 132 is in a convex configuration which conforms the front rectangular fabric piece 102 and back rectangular fabric piece 104 to a convex position 134. The user may manipulate the thin and flexible metal strip 132 into different configurations and thus change middle sections 124 position for a better fit.

In a preferred embodiment, the middle section 124 of the wearable apparel with pockets 100 has the largest width in the invention. The second width dotted line 128 and the third dotted line 136 show the middle section's 124 maximal width. The third dotted line 136 also shows the point where the middle section 124 transitions to the second section 138 and indicates that the total length of the wearable apparel with pockets varies between embodiments adapted according to use case, wearer size, and other considerations that affect the desired length.

In a preferred embodiment, the second section 138 of the wearable apparel with pockets 100 has nearly identical components as the first section 108, but the second section 138 lacks a tag 110. There is the second pocket compartment 144 located on the top side border of the wearable apparel with pockets 100. The second zipper 146 is positioned over the third pocket threaded stitching 148—the third pocket threaded stitching 148 is located on the front face 112—and shows the second pocket compartment 144 is in an open configuration. To have a closed configuration, the second zipper 146 slides over the second pocket compartment 144 and ends over the second pocket threaded stitching 150. The fourth pocket threaded stitching 150 located on the front face 112. The front rectangular fabric piece 102 and back rectangular fabric piece 104, as stitched together along the perimeter and stitching 148 and 150, and with zipper 116 providing an opening, define the second pocket compartment 144 for storing the user's items. The space of this compartment 144 spans the first length 152 between the first pocket threaded stitching 148 to the second pocket threaded stitching 150.

In a preferred embodiment, the second section 138 of the wearable apparel with pockets 100 has the narrowest width at vertical side furthest away from the middle section 124. The second section 138 gradually becomes wider as it transitions to the middle section 124 which is shown by the fourth width dotted lines 140. The second section's 138 maximal width, and the second section's 138 transition point to the middle section 124, are shown by the third width dotted line 136. The continuance of the second section 138 to the middle section 124 is shown by the second arch dotted lines 142.

Figure 2:
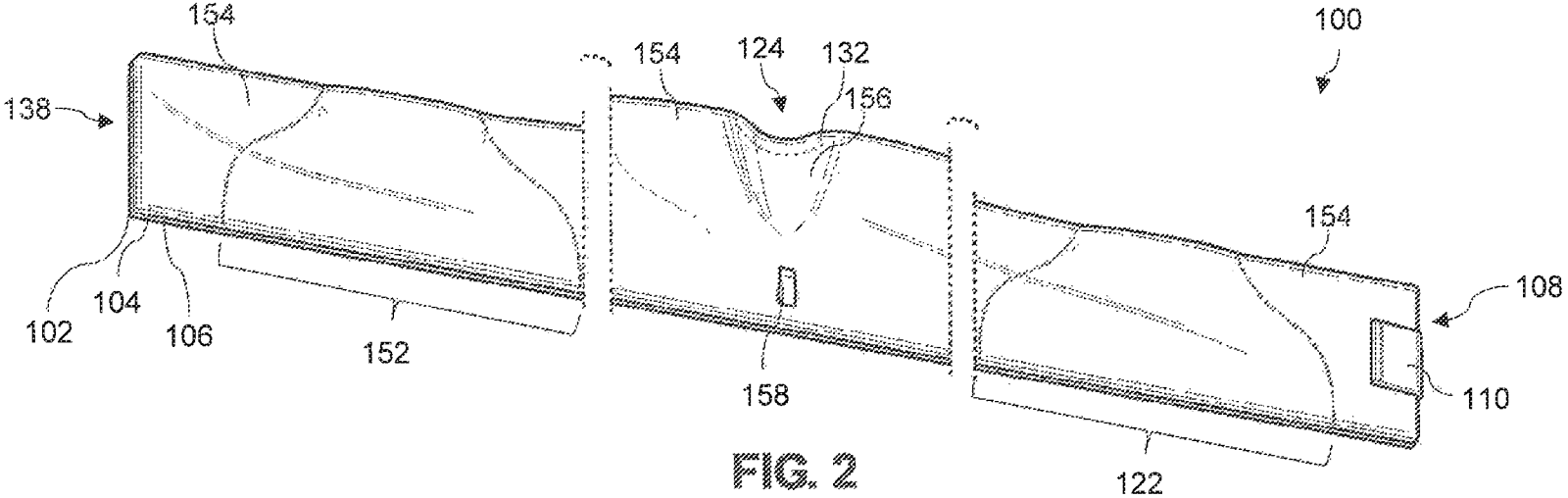
FIG. 2 is a bottom rear perspective view of the preferred embodiment of the wearable apparel with pockets showing the fabric layers and hook.

Referring now to FIG. 2, a bottom rear perspective view of the preferred embodiment of the wearable apparel with pockets 100 is shown, illustrating the rear face 154 of the invention. In terms of configuration and layout, FIG. 2 is nearly identical to FIG. 1, but with some exceptions. What remains identical is in a flipped orientation from FIG. 1. The tag 110 wraps around from the front face 112. The same stitching on the tag 110 from the front face 112 attaches the tag 110 to the rear face 154 on the first section 108. The first pocket threaded stitching 118 and second pocket threaded stitching 120, on the first section 108, and the third pocket threaded stitching 148 and fourth pocket threaded stitching 150, located on the second section 138, penetrates through the front face 112 to the rear face 154.

In a preferred embodiment, from the rear face 154 view, the thin and flexible metal strip 132, located in the middle section 124 near the top border, is in a concave configuration which conforms the front rectangular fabric piece 102 and back rectangular fabric piece 104 to a concave position 156 in the middle section 124. In another preferred embodiment, metal strip 132 is initially flat until the wearer bends it as desired. In a preferred embodiment, there is a fabric hook 158 attached below the concave position 156. The user may use the fabric hook 158 in different situations such as latching it onto other apparatuses for storage.

Figure 3:
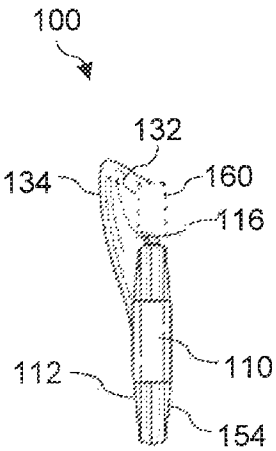
FIG. 3 is a side view of the preferred embodiment of the wearable apparel with pockets showing the tag, first section vertical side border, and middle section.

Referring now to FIG. 3, a side view of the preferred embodiment of the wearable apparel with pockets 100 showing the tag 110, first section 108 vertical side border, middle section 124. The tag 110 wraps around from the front face 112 to the rear face 154. The first dotted lines box 160 shows how the first section 108 continues and gradually increases in width as it transitions to the middle section 124, as appropriate to different embodiments of varying lengths and styles.

Figure 4:
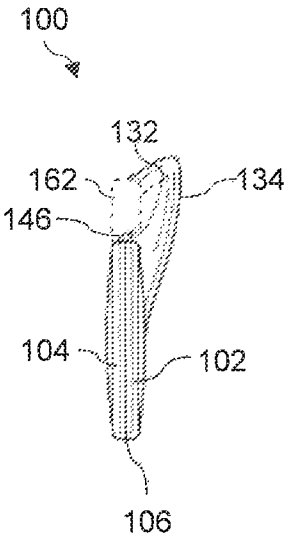
FIG. 4 is a side view of the preferred embodiment of the wearable apparel with pockets showing the second section vertical side border and middle section.

Referring now to FIG. 4, a side view of the preferred embodiment of the wearable apparel with pockets 100 showing the second section 138 vertical side border and middle section 124. The second dotted lines box 162 shows how the second section 138 continues and gradually increases in width as it transitions to the middle section 124, as appropriate to the embodiment and its length.

Figure 5:
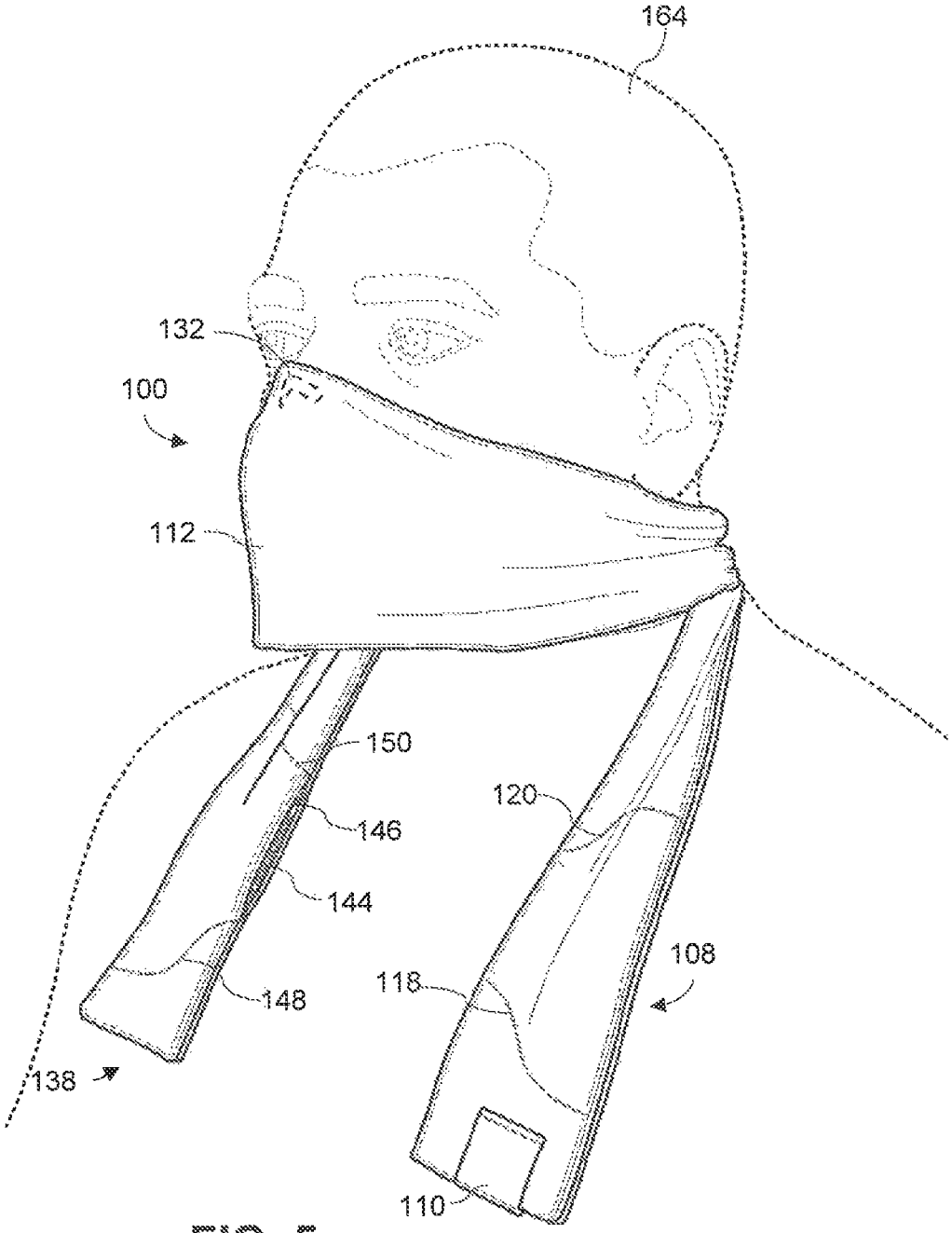
FIG. 5 is an illustration of a preferred embodiment of the wearable apparel with pockets in a wrapped configuration around the back of a wearer's neck and covering the wearer's mouth and nose for use as a face mask.

Referring now to FIG. 5, an illustration of a preferred embodiment of the wearable apparel with pockets 100, with the second pocket compartment 144, placed on a human head 164 is shown. FIG. 5 illustrates one of many ways the user may put on the wearable apparel with pockets 100. The thin and metal strip 132 in a convex configuration conforms the middle section 124 to a convex position 134 that covers human head's 164 nose and mouth area. This covering operates as a face mask and protects the user from external factors such as dust, bacteria, or viruses.

While there have been shown what are presently considered to be preferred embodiments of the present invention, it will be apparent to those skilled in the art that various changes and modifications can be made herein without departing from the scope and spirit of the invention.

What is claimed is:

1. A wearable item of apparel, comprising:

a front piece comprising an elongated piece of fabric and having a perimeter;

a back piece comprising an elongated piece of fabric substantially similar size to the front piece, the back piece having a perimeter aligned with the perimeter of the front piece and stitched along the perimeter of the front piece;

a first section beginning at a first end;

a second section beginning at a second end;

a first pocket compartment in the first section;

a second pocket compartment in the second section;

a middle section located between the first section and the second section, and wherein the middle section comprises a width that is greater than a width at the first end and the second end.

2. The wearable item of apparel as recited in claim 1, wherein the first pocket compartment is defined by a first opening in stitching along a top of the perimeter of the front piece and the back piece, a first pocket stitching in the first section, a second pocket stitching in the first section, and a bottom of the perimeter; and wherein the second pocket compartment is defined by a second opening in stitching along the top of the perimeter of the front piece and the back piece, a third pocket stitching in the second section, a fourth pocket stitching in the second section, and the bottom of the perimeter.

3. The wearable item of apparel as recited in claim 2, further comprising:

a first zipper along the first opening configured to allow the first pocket compartment to be alternated between an open configuration and a closed configuration; and a second zipper along the second opening configured to allow the second pocket compartment to be alternated between an open configuration and a closed configuration.

4. The wearable item of apparel as recited in claim 3, further comprising a fabric hook in the middle section.

5. The wearable item of apparel as recited in claim 4, wherein the fabric hook is attached to the back piece.

6. The wearable item of apparel as recited in claim 3, further comprising a tag at the first end, the tag wrapping around from an outer surface of the front piece to an outer surface of the back piece.

7. The wearable item of apparel as recited in claim 3, further comprising a thin, flexible metal strip proximate the top of the perimeter in the middle section.

8. A wearable item of apparel, comprising:

a body comprising a substantially rectangular shape and having:

a front surface;

a back surface;

a first section;

a second section;

a middle section located between the first section and the second section, the middle section wider than the first section and the second section;

a first pocket compartment in the first section; and a second pocket compartment in the second section.

9. The wearable item of apparel as recited in claim 8, further comprising a fabric hook in the middle section.

10. The wearable item of apparel as recited in claim 9, wherein the fabric hook is located on the back surface.

11. The wearable item of apparel as recited in claim 8, further comprising a tag on the first section.

12. The wearable item of apparel as recited in claim 11, wherein the tag wraps around from the front surface to the back surface.

13. The wearable item of apparel as recited in claim 12, wherein the tag is attached to the first section by stitching.

14. The wearable item of apparel as recited in claim 8, further comprising a first zipper configured to allow the first pocket compartment to be alternated between an open configuration and a closed configuration, and a second zipper configured to allow the second pocket compartment to be alternated between an open configuration and a closed configuration.

15. The wearable item of apparel as recited in claim 8, further comprising a thin, flexible metal strip located inside the body in the middle section.

16. The wearable item of apparel as recited in claim 15, wherein the metal strip is located near a top border of the body.

17. The wearable item of apparel as recited in claim 16, wherein the metal strip is in a convex configuration.

18. The wearable item of apparel as recited in claim 17, wherein the metal strip is manipulable from the convex configuration for a better fit for a user.

19. A wearable item of apparel, comprising:

a body comprising a substantially rectangular shape and having:

a front surface;

a back surface;

a top border;

a first section;

a second section;

a middle section located between the first section and the second section, wherein the middle section has a width that is greater than a width for the first section and the second section;

a first pocket compartment in the first section and having a zipper;

a second pocket compartment in the second section and having a zipper;

a flexible metal strip located inside the body in the middle section near the top border;

a fabric hook located in the middle section below the flexible metal strip; and a tag on the first section, the tag wrapping around from the front surface to the back surface.

* * * * *